United States Patent [19]

Ohno et al.

[11] Patent Number: 4,589,455

[45] Date of Patent: May 20, 1986

[54] FLUID INJECTION DEVICE FOR TRANSMITTING FLUID

[75] Inventors: Youzi Ohno, Nara; Yoshiaki Sato, Tenri; Yoshito Yamashita; Etsuo Mizukami, both of Nara, all of Japan

[73] Assignee: Sharp Kabushiki Kaisha, Osaka, Japan

[21] Appl. No.: 662,599

[22] Filed: Oct. 19, 1984

[30] Foreign Application Priority Data

Oct. 28, 1983 [JP] Japan ..... 58-167867[U]
Jan. 31, 1984 [JP] Japan ..... 59-13303[U]
Apr. 18, 1984 [JP] Japan ..... 59-57641[U]

[51] Int. Cl.[4] ..... B65B 3/04
[52] U.S. Cl. ..... 141/311 R; 141/383
[58] Field of Search ..... 604/905; 141/311 R, 141/382–386

[56] References Cited

U.S. PATENT DOCUMENTS

D. 265,380 7/1982 Addington ..... 141/383

*Primary Examiner*—Houston S. Bell, Jr.
*Attorney, Agent, or Firm*—Birch, Stewart, Kolasch & Birch

[57] ABSTRACT

A fluid injection device that effectively injects fluid into an external circumfluid unit, for example, a thin-film EL panel requiring injection of moisture-proof oil. There is disclosed an extremely convenient fluid injection device that can repeatedly perform fluid injections without replacing the fluid injection pipe merely by pressing the fluid injection pipe against the fluid receiver part using a clip. The preferred embodiment uses such a clip freely mountable and removable, which elastically sandwiches a joint pipe by a flange portion and the fluid receiver part so that the opening in the tip portion of the fluid injection pipe can be tightly pressed against the fluid receiver part.

3 Claims, 5 Drawing Figures

FLUID INJECTION DEVICE FOR TRANSMITTING FLUID

BACKGROUND OF THE INVENTION

The present invention relates to a fluid injection device which is extremely useful for injecting fluid into an externally circumfluid unit, for example, a thin-film EL panel requiring injection of moisture-proof oil.

Conventionally, such a device being used for injection of fluid into an externally circumfluid unit first inserts an injection pipe 2 into the inlet provided on a dish-type glass substrate of the external circumfluid unit such as a thin-film EL panel shown in FIG. 1, and then provides sealing around the inlet using adhesive agent 3 to prevent fluid leakage so that the injection pipe 2 can be integrated with the external unit 1, and finally injects oil into the external unit 1 through the injection pipe 2. After completing the oil injection, the conventional method presses portion a of the injection pipe 2 from both sides to provisionally seal it, and then cuts off the pipe above the pressed portion, and finally seals the cut portion with resin. Such a conventional method however needs to replace the injection pipe in each fluid injection, and yet, it always involves complex work to be done and cannot quickly and continuously inject oil into the external circumfluid unit.

OBJECT AND SUMMARY OF THE INVENTION

To effectively eliminate such inconveniences and complex work inherent to conventional injection methods, the present invention has been accomplished, which aims at providing an extremely convenient fluid injection device capable of repeatedly injecting fluid into the external unit receiving it. Another object of the present invention is to provide a useful fluid injection device that can repeatedly use the same fluid injection pipe (which is freely mountable and removable) by tightly pressing it against the inlet of the external unit using a clip and a rubber pad without integrating both the fluid injection pipe and the external unit. A still further object of the present invention is to provide a fluid injection device that can easily perform the positioning of both the inlet of the external unit and the fluid injection pipe.

BRIEF DESCRIPTION OF THE DRAWINGS

FIG. 3 shows the plane view;

FIG. 4 shows the sectional view taken on line A—A of FIG. 3; and

FIG. 5 shows the sectional view taken on line B—B of FIG. 3.

DETAILED DESCRIPTION OF THE INVENTION

Figure 2:
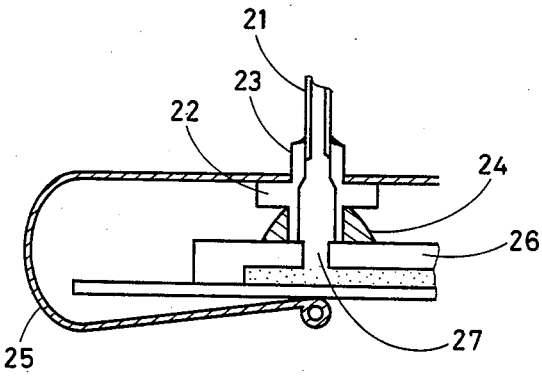
FIG. 2 shows the main configuration of one of the preferred embodiments of the present invention.

FIG. 2 shows the main configuration of the fluid injection device as one of the preferred embodiments of the present invention. In FIG. 2, reference number 21 indicates the fluid injection pipe. An oil tank and a mechanical component (not illustrated) used for the oil delivery are respectively connected to one end of the fluid injection pipe 21. A joint pipe 23 having a flange 22 is connected to the tip portion of the other end of the fluid injection pipe 21. Reference number 24 indicates a rubber pad mounted on a tip portion of the joint pipe 23. The rubber pad 24 is provided to prevent oil leakage during injection and also to securely bond the joint pipe 23 and the external unit as well. Reference number 25 indicates a clip made of a U-shaped metal sheet. Either a hole or a groove having a diameter slightly greater than the outer diameter of the joint pipe 23 is provided on a specific portion of the clip 25. As shown in FIG. 2, the fluid injection pipe 21 is inserted into the upper part of the joint pipe 23 so that its tip-end portion can be held by the flange 22 of the joint pipe 23. This configuration permits the tip opening of the joint pipe 23 to correctly match or align with the oil inlet 27 provided for the external unit 26, for example, a thin-film EL panel that needs injection of fluid. At the same time, by effect of inserting one end of the clip 25 into the upper portion of the joint pipe 23 with the other end being set to the back of the external unit 26, and also by the elastic property of the clip 25, the joint pipe 23 and the external unit 26 are pressed to each other. In addition to this pressure, by effect of the elasticity of the rubber pad 24, the joint pipe 23 and the inlet 27 are tightly connected. In other words, clip 25 causes the tip portion of the joint pipe 23 to be tightly pressed against the opening of the oil inlet 27 of the external unit 26 so that the rubber pad 24 can tightly seal the pressed portion using its own elasticity.

Then, by decreasing the ambient pressure in such a condition as mentioned above, the internal part of the external unit 26 for a vacuum created from the tip portion of the fluid injection pipe 21, and then the tip portion of the fluid injection pipe 21 is inserted into oil before the normal pressure is restored. As a result, oil can be injected into the external unit 26 through the fluid injection pipe 21 and the joint pipe 23. After completing oil injection, the U-shaped clip 25 expands so that it slides to the left before being disengaged from the external unit 26. This causes both the fluid injection pipe 21 and the joint pipe 23 to be also disengaged simultaneously. Such the mechanism allows the operator to perform oil injection works against other external units using the same fluid injection device.

Figure 5:
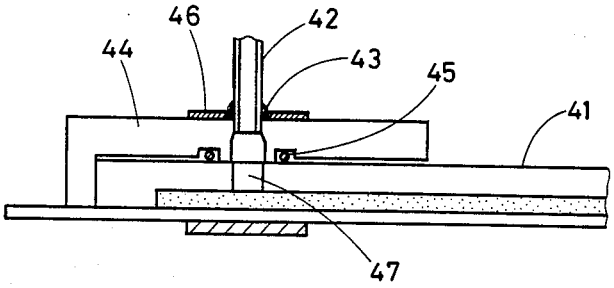
FIGS. 3 through 5 respectively show the main configuration of the fluid injection device according to another preferred embodiment of the present invention.
Figure 1:
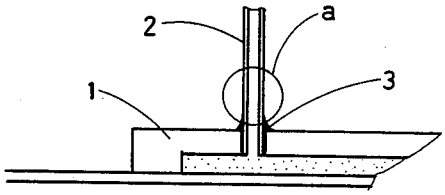
FIG. 1 shows the main configuration of a conventional oil injection device.
Figure 3:
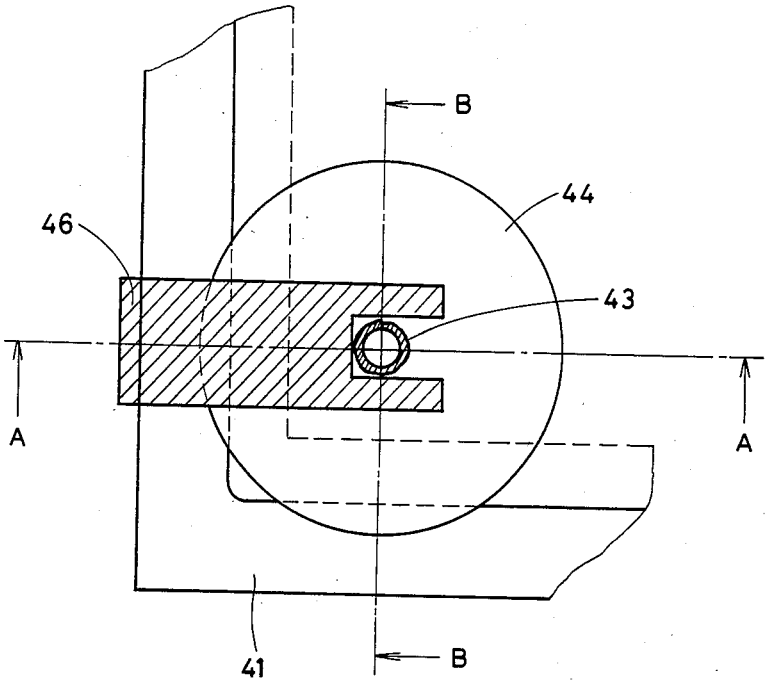
Figure 4:
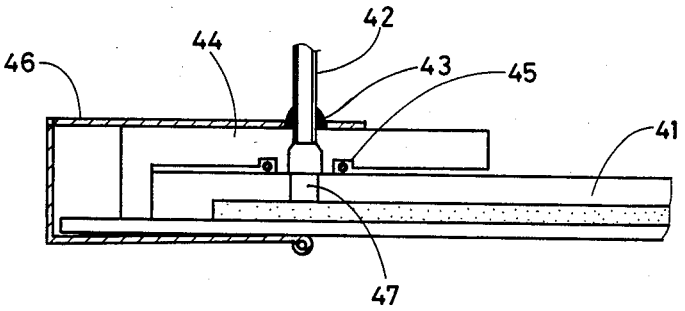

FIGS. 3 through 5 respectively show the main parts of the fluid injection device as another preferred embodiment of the present invention. FIG. 3 shows its plain view. FIG. 4 shows the sectional view taken on line A—A of FIG. 3, and FIG. 5 also shows the sectional view taken on line B—B of FIG. 3. Referring now to these Figures, reference number 41 indicates the EL display unit receiving fluid, reference number 42 indicates the fluid injection pipe and 43 adhesive agent, respectively. Reference number 44 indicates the fluid injection pipe positioning tool that determines the position of the fluid injection pipe 42 by coming into contact with the lateral surface of the sealing glass of the EL display device 41. Reference number 45 indicates the oil leakage prevention O-ring. Reference number 46 indicates the freely mountable and removable clip that elastically sandwiches both the fluid injection pipe positioning tool 44 and the EL display device 41 so that the opening in the tip portion of the fluid injection pipe 42 can be tightly pressed against the inlet of the EL display device 41.

Those preferred embodiments thus described above provide an extremely useful fluid injection device that permits not only an easy positioning of the fluid injection pipe and the inlet, but also permits repeated fluid injection processes without replacing the fluid injection pipe at all.

What is claimed is:

1. A fluid injection device for injecting fluid into an inlet of a receiver part from an opening of a fluid injection pipe comprising:

a joint pipe having a flange portion formed between an opening therein for receipt of a tip portion of said fluid injection pipe and an opening therein for introducing a fluid into said receiver part;

a clip freely mountable and removable, which elastically sandwiches said joint pipe by said flange to said inlet of said fluid receiver part to cause said respective opening in said joint pipe to be tightly pressed against said inlet of said fluid receiver part; and a rubber pad installed about a circumference of a tip portion of said joint pipe where said joint pipe is tightly pressed against said fluid receiver part.

2. The device of claim 1, wherein said openings of said joint pipe align said opening of said fluid injection pipe with said inlet of said receiver part.

3. The device of claim 2, further including a positioning means for aligning said respective openings of said fluid injection pipe, joint pipe and receiver part.

* * * * *